US011740581B2

(12) United States Patent
Murauchi et al.

(10) Patent No.: US 11,740,581 B2
(45) Date of Patent: Aug. 29, 2023

(54) ELASTIC MEMBER, CLEANING DEVICE, AND IMAGE FORMING APPARATUS

(71) Applicant: Konica Minolta, Inc., Tokyo (JP)

(72) Inventors: Junji Murauchi, Toyokawa (JP); Ken Nakano, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/662,337

(22) Filed: May 6, 2022

(65) Prior Publication Data

US 2022/0373958 A1 Nov. 24, 2022

(30) Foreign Application Priority Data

May 21, 2021 (JP) ..... 2021-086138

(51) Int. Cl.
*G03G 21/00* (2006.01)
*G03G 15/08* (2006.01)

(52) U.S. Cl.
CPC ..... *G03G 21/0011* (2013.01); *G03G 15/0812* (2013.01)

(58) Field of Classification Search
CPC ..... G03G 21/0011; G03G 15/0812
See application file for complete search history.

(56) References Cited

U.S. PATENT DOCUMENTS 5,237,375 A * 8/1993 Michlin ..... G03G 21/1814 101/169
6,021,297 A * 2/2000 Campbell ..... G03G 15/0812 399/284
6,212,348 B1 * 4/2001 Inoue ..... G03G 15/0812 399/284
8,064,814 B2 * 11/2011 Kagawa ..... G03G 15/2025 399/327
8,798,516 B2 * 8/2014 Okamoto ..... G03G 21/0017 399/350
10,859,962 B2 * 12/2020 Schlumm ..... G03G 21/0011
2009/0097893 A1 * 4/2009 Kiuchi ..... G03G 21/0011 399/350
2009/0110430 A1 * 4/2009 Kubota ..... G03G 15/0898 399/103
2010/0003058 A1 * 1/2010 Hori ..... G03G 15/0812 399/284
2016/0238989 A1 * 8/2016 Nakamura ..... G03G 15/0815
(Continued)

FOREIGN PATENT DOCUMENTS

EP 1176794 A2 * 1/2002 ..... G03G 15/206
JP 59095553 A * 6/1984
(Continued)

*Primary Examiner* — Ryan D Walsh

(74) *Attorney, Agent, or Firm* — LUCAS & MERCANTI, LLP

(57) ABSTRACT

An elastic member that comes into contact with a moving body that moves in a predetermined moving direction to scrape off a deposit on the moving body includes: a stress reducer that is provided at a contact end on a side to be in contact with the moving body and reduces vibration of internal stress generated due to contact between the moving body and the elastic member, wherein the stress reducer extends in a direction that is not perpendicular to the moving direction when the elastic member comes in contact with the moving body.

10 Claims, 8 Drawing Sheets

(56) References Cited

U.S. PATENT DOCUMENTS

| | | | | |
|---|---|---|---|---|
| 2016/0282754 | A1* | 9/2016 | Kuramoto | G03G 15/0812 |
| 2018/0011434 | A1* | 1/2018 | Adachi | G03G 15/2025 |
| 2022/0342357 | A1* | 10/2022 | Nakane | G03G 21/169 |

FOREIGN PATENT DOCUMENTS

| | | | | | |
|---|---|---|---|---|---|
| JP | 60051867 | A | * | 3/1985 | |
| JP | 63085783 | A | * | 4/1988 | |
| JP | 2002-082587 | A | | 3/2002 | |
| JP | 2011-197251 | A | | 10/2011 | |
| JP | 2018054686 | A | * | 4/2018 | G03G 15/0812 |
| JP | 2018-189848 | A | | 11/2018 | |

* cited by examiner

FIG. 10

| | FIRST COMPARATIVE EXAMPLE | SECOND COMPARATIVE EXAMPLE | FIRST EXAMPLE | SECOND EXAMPLE |
|---|---|---|---|---|
| STRESS | 1.00 | 0.17 | 0.50 | 0.33 |
| PULL-IN AMOUNT | LARGE | SMALL | SMALL | SMALL |
| VIBRATION | LARGE | SMALL | MEDIUM | SMALL |

FIG. 11

| | COMPARATIVE EXAMPLE | THIRD EXAMPLE | FOURTH EXAMPLE | FIFTH EXAMPLE | SIXTH EXAMPLE |
|---|---|---|---|---|---|
| CURLING | × | ○ | ◎ | ○ | ○ |

FIG. 12

| | 5° | 10° | 45° | 80° | 85° |
|---|---|---|---|---|---|
| CURLING | ○ | ◎ | ◎ | ◎ | ○ |

ELASTIC MEMBER, CLEANING DEVICE, AND IMAGE FORMING APPARATUS

The entire disclosure of Japanese patent Application No. 2021-086138, filed on May 21, 2021, is incorporated herein by reference in its entirety.

BACKGROUND

Technological Field

The present invention relates to an elastic member, a cleaning device, and an image forming apparatus.

Description of the Related Art

An electrophotographic image forming apparatus is provided with a cleaning device that removes a deposit on a moving body by bringing an elastic member such as a cleaning blade into contact with a surface of an image carrier (for example, a moving body such as a photoconductor drum) that carries a toner image.

Incidentally, with an increase in speed of the image forming apparatus in recent years, by an increase in moving speed of the moving body, a frictional force generated between the elastic member and the moving body increases, and thus there are problems that the elastic member is easily curled, and the elastic member is easily worn and eventually is easily subjected to part replacement.

When the part replacement occurs more frequently, productivity of the image forming apparatus is affected by a loss due to replacement time, and therefore, in order to reduce a loss of the part replacement from the viewpoint of improving productivity, it is a problem to reduce stress and extend life of the elastic member.

In order to solve such a problem, for example, JP 2002-082587 A discloses a configuration in which a cleaning member in contact with an image carrier is brought into contact with the image carrier at an angle with respect to a driving direction of the image carrier. Further, JP 2018-189848 A discloses a configuration in which only an end can be brought into oblique contact with an image carrier. In the configurations described in JP 2002-082587 A and JP 2018-189848 A, a frictional force generated between the cleaning member and the image carrier is applied to a portion inclined with respect to the moving direction of the image carrier to reduce vibration of internal stress, so that it is possible to suppress curling of the elastic member and wear of the elastic member.

Further, JP 2011-197251 A discloses a configuration in which a slit extending in a direction orthogonal to the moving direction of the image carrier is formed in the cleaning member. In this technique, the contact pressure of the cleaning member is increased by opening the slit when the cleaning member and the image carrier are brought into contact with each other.

However, in the configuration described in JP 2002-082587 A, since the elastic member is brought into contact with the moving body at the angle with respect to the moving direction of the moving body, it is necessary to secure a space for disposing the elastic member. Further, in the configuration described in JP 2018-189848 A, similarly, it is necessary to secure a space for disposing the inclined portion of the end.

Therefore, in the configurations described in JP 2002-082587 A and JP 2018-189848 A, in a case of a configuration having a relatively wide moving body, there is a case where it is impossible to arrange the elastic member. Thus, there is a certain limit as a configuration for suppressing curling of the elastic member and abrasion of the elastic member, and it is a configuration in which the life of the elastic member cannot be extended.

Further, in the configuration described in JP 2011-197251 A, since the vibration of the internal stress cannot be reduced, there is a certain limit as a configuration for suppressing wear of the elastic member.

SUMMARY

An object of the present invention is to provide an elastic member, a cleaning device, and an image forming apparatus capable of extending life.

To achieve the abovementioned object, according to an aspect of the present invention, there is provided an elastic member that comes into contact with a moving body that moves in a predetermined moving direction to scrape off a deposit on the moving body, and the elastic member reflecting one aspect of the present invention comprises: a stress reducer that is provided at a contact end on a side to be in contact with the moving body and reduces vibration of internal stress generated due to contact between the moving body and the elastic member, wherein the stress reducer extends in a direction that is not perpendicular to the moving direction when the elastic member comes in contact with the moving body.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 10 is a table illustrating experimental results of the first evaluation experiment;

FIG. 11 is a table illustrating experimental results of a second evaluation experiment; and FIG. 12 is a table illustrating experimental results of a third evaluation experiment.

DETAILED DESCRIPTION OF EMBODIMENTS

Figure 1:
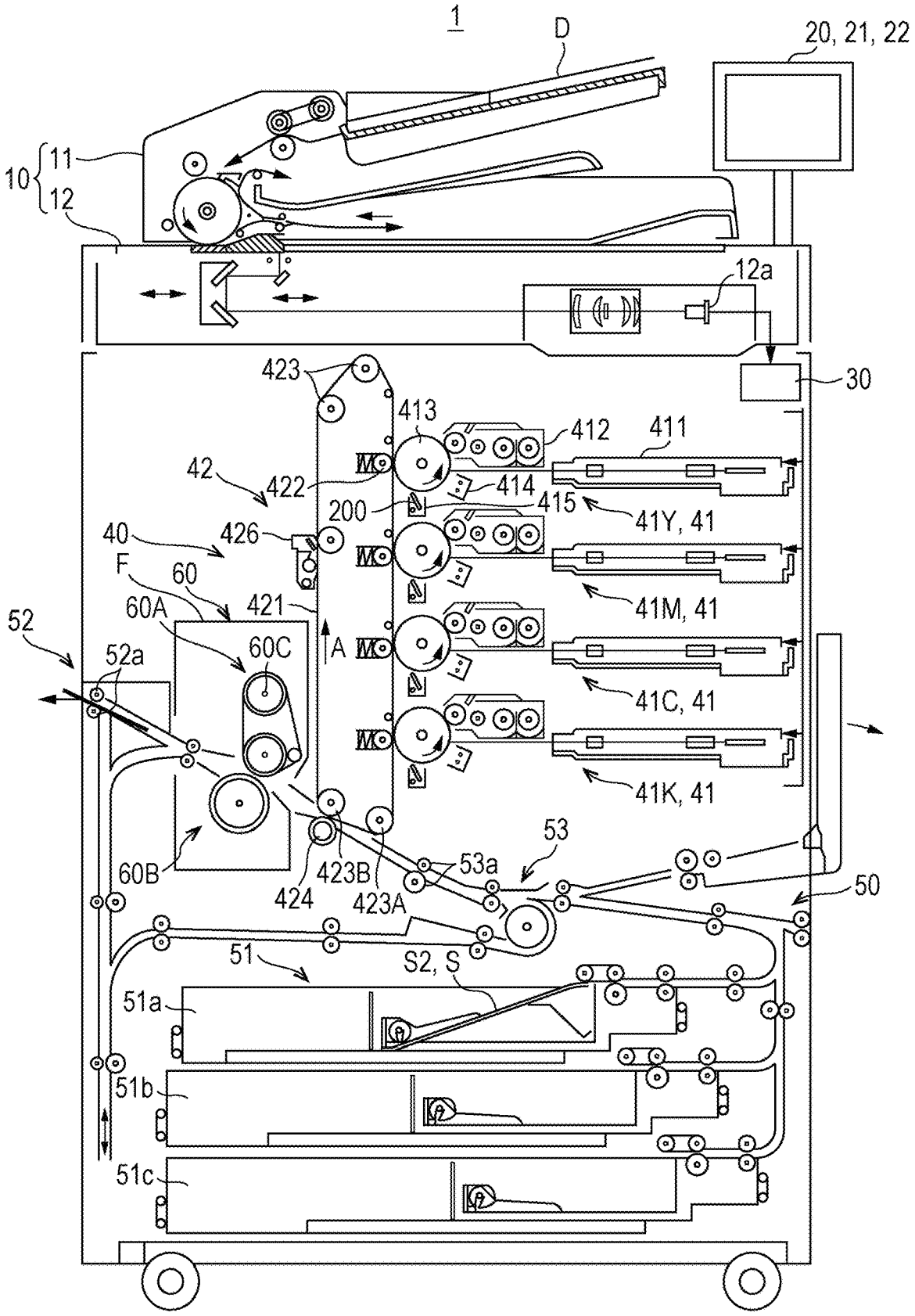
FIG. 1 is a view schematically illustrating an overall configuration of an image forming apparatus according to an embodiment of the present invention.
Figure 2:
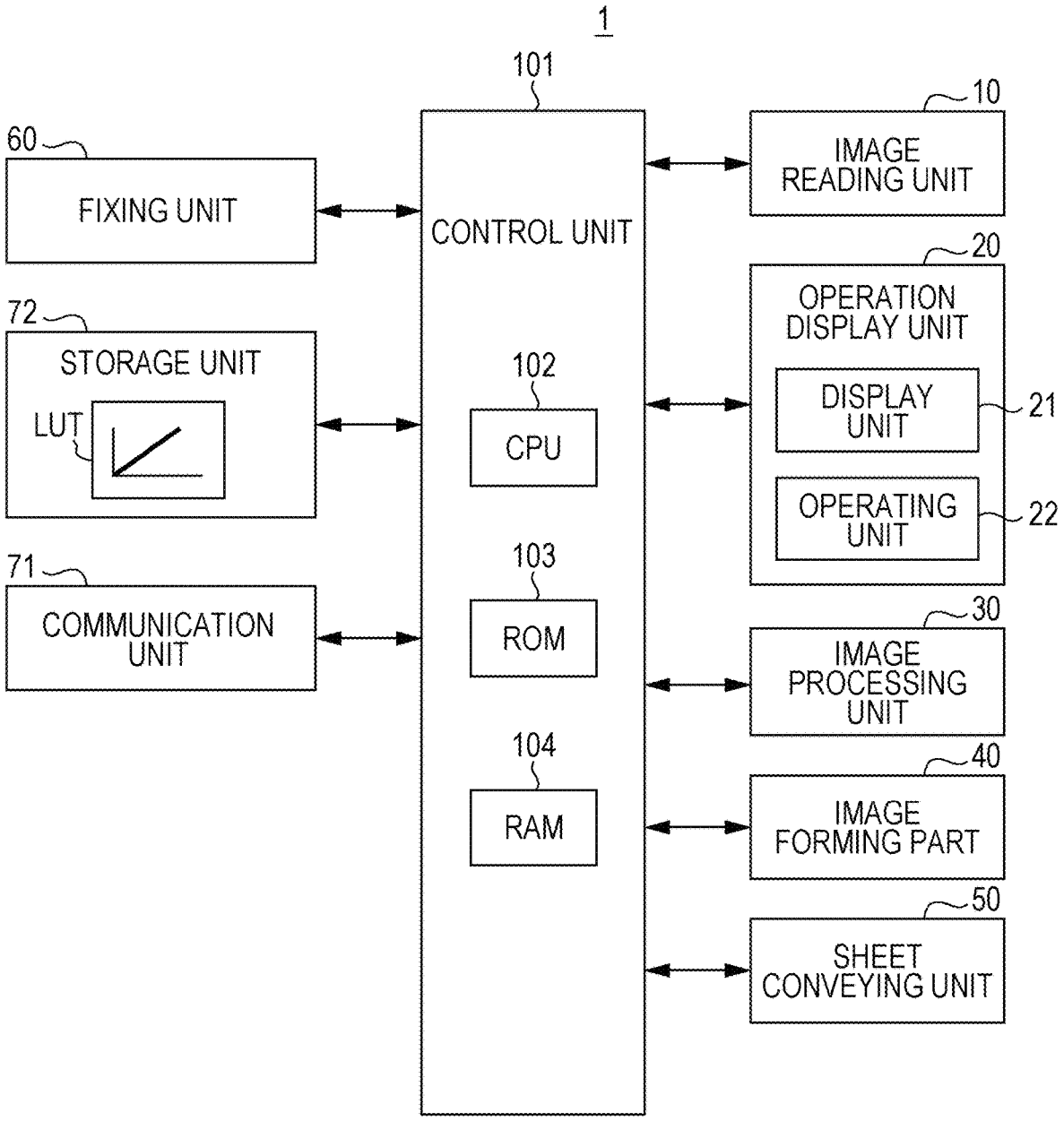
FIG. 2 is a diagram illustrating a main part of a control system of the image forming apparatus according to the present embodiment.

Hereinafter, one or more embodiments of the present invention will be described with reference to the drawings. However, the scope of the invention is not limited to the disclosed embodiments. FIG. 1 is a view schematically illustrating an overall configuration of an image forming apparatus 1 according to an embodiment of the present invention. FIG. 2 is a diagram illustrating a main part of a control system of the image forming apparatus 1 according to the present embodiment.

The image forming apparatus 1 illustrated in FIGS. 1 and 2 is an intermediate transfer type color image forming apparatus using an electrophotographic process technology. That is, the image forming apparatus 1 primarily transfers toner images of respective colors of yellow (Y), magenta (M), cyan (C), and black (K) formed on a photoconductor drum 413 onto an intermediate transfer belt 421, superimposes the toner images of four colors on the intermediate transfer belt 421, and thereafter secondarily transfers the toner images to a sheet S (recording medium), to thereby form an image.

Further, in the image forming apparatus 1, a tandem system is employed in which photoconductor drums 413 corresponding to four colors of YMCK are arranged in series in a running direction of the intermediate transfer belt 421, and toner images of the respective colors are sequentially transferred to the intermediate transfer belt 421 in one procedure.

As illustrated in FIG. 2, the image forming apparatus 1 includes an image reading unit 10, an operation display unit 20, an image processing unit 30, an image forming part 40, a sheet conveying unit 50, a fixing unit 60, and a controller 101.

The controller 101 includes a central processing unit (CPU) 102, a read only memory (ROM) 103, a random access memory (RAM) 104, and so on. The CPU 102 reads out a program corresponding to processing content from the ROM 103, expands the program in the RAM 104, and centrally controls operation of each block of the image forming apparatus 1 in cooperation with the expanded program. At this time, various data stored in a storage unit 72 is referred to. The storage unit 72 includes, for example, a nonvolatile semiconductor memory (what is called a flash memory) or a hard disk drive.

The controller 101 transmits and receives various data to and from an external device (for example, a personal computer) connected to a communication network such as a local area network (LAN) and a wide area network (WAN) via a communication unit 71. The controller 101 receives, for example, image data (input image data) transmitted from the external device, and forms an image on the sheet S based on this image data. The communication unit 71 includes a communication control card such as a LAN card, for example.

As illustrated in FIG. 1, the image reading unit 10 includes an automatic document feeding device 11 called an auto document feeder (ADF), a document image scanning device 12 (scanner), and so on.

The automatic document feeding device 11 conveys a document D placed on a document tray by a conveying mechanism and feeds it to the document image scanning device 12. By the automatic document feeding device 11, it is possible to continuously read images (including both sides) of a large number of documents D placed on the document tray all at once.

The document image scanning device 12 optically scans a document conveyed from the automatic document feeding device 11 onto a contact glass or a document placed on the contact glass, allows reflected light from the document to form an image on a light receiving surface of a charge coupled device (CCD) sensor 12*a*, and reads a document image. The image reading unit 10 generates input image data based on a reading result of the document image scanning device 12. The input image data is subjected to predetermined image processing in the image processing unit 30.

As illustrated in FIG. 2, the operation display unit 20 includes, for example, a liquid crystal display (LCD) with a touch panel, and functions as a display unit 21 and an operating unit 22. The display unit 21 displays various operation screens, image states, operation states of each function, and the like according to a display control signal input from the controller 101. The operating unit 22 includes various operation keys such as a numeric keypad and a start key, receives various input operations by a user, and outputs an operation signal to the controller 101.

The image processing unit 30 includes a circuit or the like that performs digital image processing on the input image data according to initial settings or user settings. For example, the image processing unit 30 performs gradation correction under control of the controller 101 based on gradation correction data (gradation correction table). Further, the image processing unit 30 performs various correction processing such as color correction and shading correction, compression processing, and the like on the input image data, in addition to the gradation correction. The image forming part 40 is controlled based on the image data that has been subjected to these processes.

As illustrated in FIG. 1, the image forming part 40 includes image forming units 41Y, 41M, 41C, and 41K for forming images with respective color toners of Y, M, C, and K components based on the input image data, an intermediate transfer unit 42, and so on.

The image forming units 41Y, 41M, 41C, and 41K for the Y, M, C, and K components have similar configurations. For convenience of illustration and description, common components are denoted by the same reference numerals, and when distinguishing from each other, reference numerals are appended with Y, M, C, or K. In FIG. 1, reference signs are only given to components of the image forming unit 41Y for Y component, and reference signs are omitted for components of the other image forming units 41M, 41C, and 41K.

The image forming unit 41 includes an exposure device 411, a developing device 412, a photoconductor drum 413, a charging device 414, a drum cleaning device 415, and so on.

The photoconductor drum 413 is formed by, for example, an organic photoconductor in which a photoconductive layer formed by resin containing an organic photoconductor is formed on an outer peripheral surface of a drum-shaped metal base.

The controller 101 controls a drive current supplied to a drive motor (not illustrated) for rotating the photoconductor drum 413, thereby rotating the photoconductor drum 413 at a constant peripheral speed.

The charging device 414 is, for example, an electrostatic charger and generates a corona discharge to thereby uniformly charge a surface of the photoconductor drum 413 having photoconductivity to a negative polarity.

The exposure device 411 includes, for example, a semiconductor laser and irradiates the photoconductor drum 413 with laser light corresponding to an image of each color component. As a result, an electrostatic latent image of each color component is formed in an image area of a surface of the photoconductor drum 413, the image area being irradiated with the laser light, due to the potential difference from a background area.

The developing device 412 is a two-component reverse type developing device, and adheres a developer of each color component to the surface of the photoconductor drum 413, to thereby visualize the electrostatic latent image to form a toner image.

For example, a DC developing bias having the same polarity as a charging polarity of the charging device 414 or a developing bias in which a DC voltage having the same polarity as the charging polarity of the charging device 414 is superimposed on an AC voltage is applied to the developing device 412. As a result, reversal development for attaching the toner to the electrostatic latent image formed by the exposure device 411 is performed.

The drum cleaning device 415 includes a cleaning unit 200 and the like for cleaning the photoconductor drum 413 carrying a toner image, and removes a toner remaining on the surface of the photoconductor drum 413 without being transferred to the intermediate transfer belt 421. The drum cleaning device 415 corresponds to a "cleaning device" of the present invention. Details of the drum cleaning device 415 will be described later.

The intermediate transfer unit 42 includes the intermediate transfer belt 421, primary transfer rollers 422, a plurality of support rollers 423, a secondary transfer roller 424, a belt cleaning device 426, and so on.

The intermediate transfer unit 42 is formed by an endless belt, and is stretched in a loop around the plurality of support rollers 423. At least one of the plurality of support rollers 423 is formed by a driving roller, and the others are formed by driven rollers. For example, it is preferable that a roller 423A arranged downstream of the primary transfer roller 422 for the K component in a belt running direction is a driving roller. This makes it easier to keep a running speed of the belt in a primary transfer nip constant. Rotation of the driving roller 423A causes the intermediate transfer belt 421 to run in the direction of arrow A at a constant speed.

A primary transfer roller 422 is arranged on an inner peripheral surface side of the intermediate transfer belt 421 so as to face the photoconductor drum 413 of each color component. When the primary transfer roller 422 is pressed against the photoconductor drum 413 with the intermediate transfer belt 421 interposed therebetween, a primary transfer nip for transferring a toner image from the photoconductor drum 413 to the intermediate transfer belt 421 is formed.

The secondary transfer roller 424 is arranged on the outer peripheral surface side of the intermediate transfer belt 421, opposing a backup roller 423B arranged downstream of the driving roller 423A in the belt running direction. The secondary transfer roller 424 is pressed against the backup roller 423B with the intermediate transfer belt 421 interposed therebetween, thereby forming a secondary transfer nip for transferring a toner image from the intermediate transfer belt 421 to the sheet S.

When the intermediate transfer belt 421 passes through the primary transfer nip, the toner images on the photoconductor drum 413 are sequentially overlapped and primary-transferred on the intermediate transfer belt 421. Specifically, a primary transfer bias is applied to the primary transfer roller 422 and a charge having a polarity opposite to that of the toner is given to a back surface side of the intermediate transfer belt 421, that is, a side in contact with the primary transfer roller 422, thereby electrostatically transferring the toner image to the intermediate transfer belt 421.

Thereafter, when the sheet S passes through the secondary transfer nip, the toner image on the intermediate transfer belt 421 is secondarily transferred to the sheet S. Specifically, a secondary transfer bias is applied to the backup roller 423B and a charge having the same polarity as that of the toner is given to a front surface side of the sheet S, that is, a side in contact with the intermediate transfer belt 421 to thereby electrostatically transfer the toner image to the sheet S, and the sheet S is transferred toward the fixing unit 60.

The belt cleaning device 426 removes a transfer residual toner remaining on the surface of the intermediate transfer belt 421 after the secondary transfer. Note that instead of the secondary transfer roller 424, a configuration in which the secondary transfer belt is stretched in a loop on a plurality of support rollers including the secondary transfer roller, what is called a belt type secondary transfer unit, may be employed.

The fixing unit 60 includes an upper fixing unit 60A having a fixing surface side member arranged on the fixing surface of the sheet S, that is, the surface on which the toner image is formed, a lower fixing unit 60B having a back surface side support member arranged on the rear surface of the sheet S, that is, the surface opposite to the fixing surface, a heating source 60C, and so on. When the back surface side support member is pressed against the fixing surface side member, a fixing nip for sandwiching and conveying the sheet S is formed.

The fixing unit 60 heats and pressurizes the sheet S, to which the toner image has been secondarily transferred and which has been conveyed thereto, with the fixing nip, thereby fixing the toner image on the sheet S. The fixing unit 60 is arranged as a unit in a fixing device F.

The sheet conveying unit 50 includes a paper feed unit 51, a paper discharge unit 52, a conveying path unit 53, and so on. Sheets S identified based on basis weight, size, or the like are stored according to types set in advance in the three paper feed tray units 51*a* to 51*c* that constitute the paper feed unit 51. The conveying path unit 53 has a plurality of conveying rollers such as a resist roller pair 53*a*.

The sheets S stored in the paper feed tray units 51*a* to 51*c* are sent out one by one from an uppermost part, and are conveyed to the image forming part 40 by the conveying path unit 53. Then, in the image forming part 40, the toner image on the intermediate transfer belt 421 is secondarily transferred onto one surface of the sheet S at once, and the fixing unit 60 performs a fixing step. The sheet S on which the image is formed is discharged to the outside of the apparatus by the paper discharge unit 52 including a sheet discharge roller 52*a*.

Figure 3:
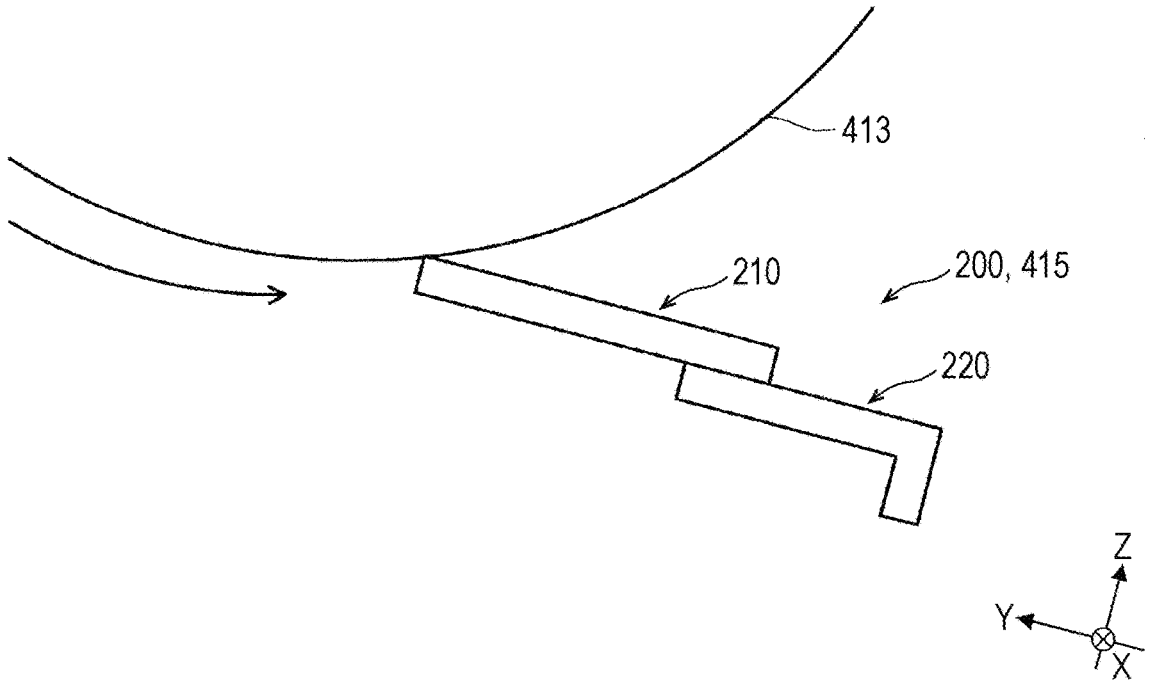
FIG. 3 is a side view of a cleaning unit.

Next, details of the drum cleaning device 415 will be described. FIG. 3 is a side view of the cleaning unit 200.

Note that an orthogonal coordinate system (X, Y, Z) is used to describe the structure of the cleaning unit 200 of the present embodiment. Also in the drawings described later, they are indicated by a common orthogonal coordinate system (X, Y, Z). The X direction is a direction parallel to a width direction of the photoconductor drum 413, and is a direction (predetermined direction) along a contact end of an elastic member 210 described later. The Y direction is a direction orthogonal to the width direction (X direction) of the photoconductor drum 413 and the thickness direction of the elastic member 210, and is a direction in which the elastic member 210 to be described later extends from a support portion of the support member 220 to be described later. The Z direction is a thickness direction of the elastic member 210.

As illustrated in FIG. 3, as described above, the drum cleaning device 415 includes the cleaning unit 200 for cleaning the photoconductor drum 413. The cleaning unit 200 includes an elastic member 210 and a support member 220.

The elastic member 210 is a plate-like member extending in the X direction and the Y direction, and is formed by, for example, polyurethane. Further, the length of the elastic member 210 in the X direction is longer than the length of the elastic member 210 in the Y direction.

Note that the thickness (length in the Z direction) of the elastic member 210 is appropriately set according to the size of the image forming apparatus 1. Further, the length of the elastic member 210 in the Y direction is appropriately set according to the size of the image forming apparatus 1.

The elastic member 210 is arranged in parallel to the X direction and such that a corner portion (contact portion) on a positive side in the Z direction at the contact end on a positive side in the Y direction is in contact with the surface of the photoconductor drum 413. Thus, the elastic member 210 comes into contact with the rotationally moving photoconductor drum 413 to thereby remove the toner remaining on the surface of the photoconductor drum 413 without being transferred to the intermediate transfer belt 421. The photoconductor drum 413 corresponds to a "moving body" of the present invention.

The support member 220 is a sheet metal that supports the elastic member 210, and is fixed to a housing or the like constituting the drum cleaning device 415. The support member 220 is formed by bending a steel plate such as SECC into an L shape.

The support member 220 supports an end on a negative side in the Y direction of the elastic member 210 from a negative side in the Z direction of the elastic member 210 at an end on the positive side in the Y direction. The support member 220 and the elastic member 210 are bonded by an adhesive, a double-sided tape, or the like.

Figure 4:
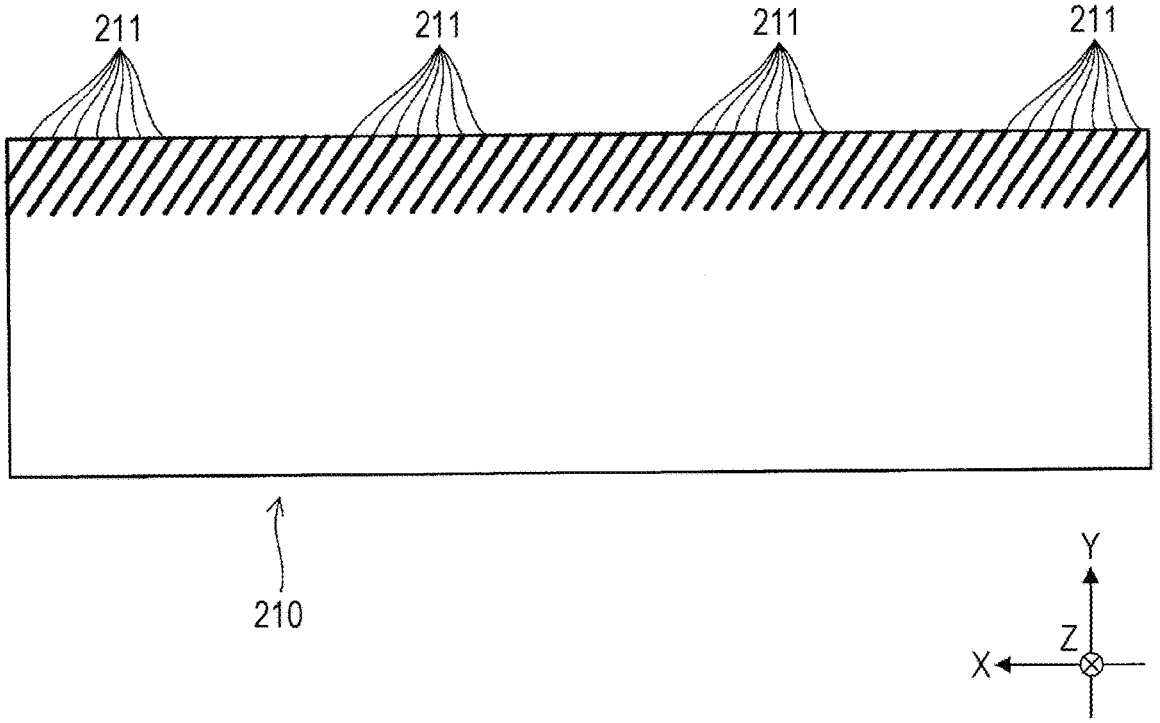
FIG. 4 is a view of an elastic member as viewed from a negative side in a Z direction.
Figure 5:
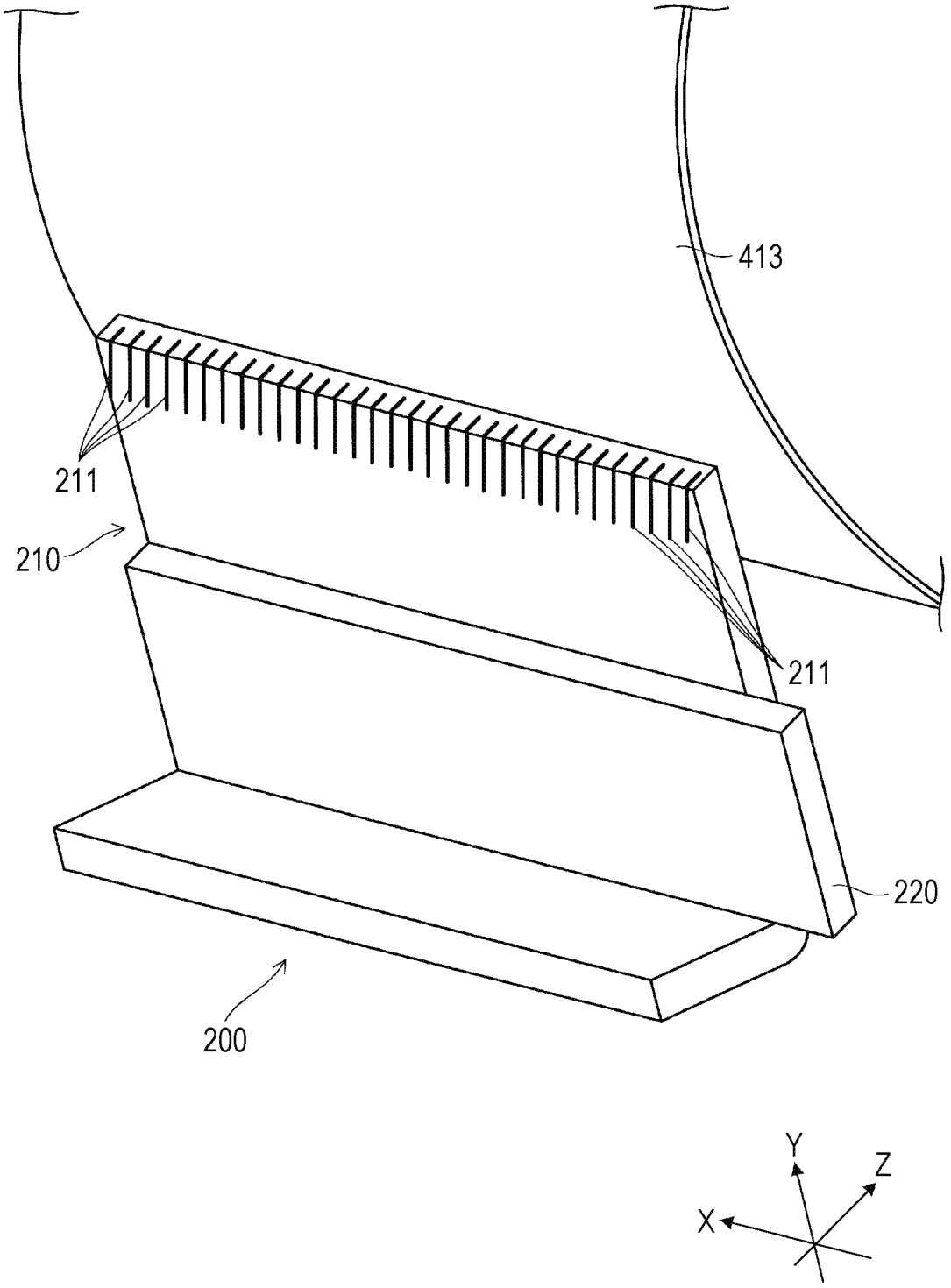
FIG. 5 is a perspective view of the cleaning unit.

Further, as illustrated in FIGS. 4 and 5, a stress reducer 211 is provided at a contact end of the elastic member 210 on a side in contact with the photoconductor drum 413 (positive side in the Y direction). The stress reducer 211 is, for example, a groove or a slit, and reduces vibration of internal stress generated due to contact between the photoconductor drum 413 and the elastic member 210.

Note that it is possible to provide the stress reducer in the elastic member, in a case where the stress reducer is a groove, by providing a groove-shaped recess in the elastic member by a molding device for the elastic member, and in a case where the stress reducer is a slit, by forming the slit in an elastic member having no stress reducer with a tool such as a cutter.

The vibration of the internal stress is vibration excited by friction at a contact portion when two members that move relative to each other come into contact with each other in a state where one of the two members receives a restoring force.

The stress reducer 211 is provided on the side (the negative side in the Z direction) opposite to the contact portion (the positive side in the Z direction) with the photoconductor drum 413 at the contact end of the elastic member 210. That is, the support member 220 supports the elastic member 210 so that the stress reducer 211 is on the side opposite to the contact portion side with the photoconductor drum 413 at the contact end.

Further, a plurality of the stress reducers 211 is provided side by side in the X direction in the entire region of the contact end in the X direction, and extends in a direction that is not perpendicular to the moving direction (Y direction) of the photoconductor drum 413 when the elastic member 210 comes in contact with the photoconductor drum 413. Specifically, the stress reducers 211 are inclined with respect to the Y direction from the contact end of the elastic member 210, and the angle between the stress reducers 211 and the Y direction is in the range of 10° to 80°. Then, the plurality of stress reducers 211 is arranged so as to be parallel to each other.

Since the elastic member 210 is in contact with the photoconductor drum 413, when the photoconductor drum 413 rotates (moves), frictional force is generated between the elastic member 210 and the photoconductor drum 413.

It is generally known that when such two members that move relative to each other are in contact with each other, vibration of internal stress based on frictional force is generated at a contact portion of the two members.

Specifically, stress is generated inside the elastic member due to a frictional force generated between the elastic member and the photoconductor drum, and vibration of the internal stress is generated. When the vibration of the internal stress is generated, the elastic member easily curls or the elastic member is easily worn due to the frictional force generated between the elastic member and the photoconductor drum and the vibration of the internal stress caused by the frictional force.

In the present embodiment, since the stress reducers 211 are provided in the elastic member 210, when a frictional force is generated between the elastic member 210 and the photoconductor drum 413, the frictional force acts on the stress reducers 211 inclined with respect to the moving direction (Y direction) of the photoconductor drum 413.

Then, it is possible to cause the stress generated along the direction parallel to the Y direction to operate in a direction oblique to the Y direction due to the presence of the stress reducers 211. Thus, since the stress in the elastic member 210 can be reduced, the vibration of the internal stress caused by the frictional force can be reduced, and eventually, curling and wear of the elastic member 210 can be suppressed.

Consequently, it is possible to extend life of the elastic member 210, and thus it is possible to reduce the frequency of replacement of the elastic member 210 and to contribute to extending life of the image forming apparatus 1.

Incidentally, in a configuration having a slit (or groove) extending in a direction perpendicular to the moving direction of the photoconductor drum, the slit is orthogonal to the frictional force generated between the photoconductor drum and the elastic member, so that stress is generated in a direction orthogonal to the slit. Thus, since such a configuration is such that the vibration of the internal stress cannot be reduced, it is not possible to suppress the curling or wear of the elastic member due to the vibration of the internal stress.

On the other hand, in the present embodiment, since the stress reducers 211 extends in the direction that is not perpendicular to the frictional force (Y direction), stress can be made to operate in the oblique direction with respect to the frictional force. Consequently, the vibration of the internal stress can be reduced, and the life of the elastic member 210 can be extended.

Further, since the plurality of stress reducers 211 is provided in the entire region of the elastic member 210 in the X direction, the vibration of the internal stress in the entire elastic member 210 can be reduced.

Figure 6:
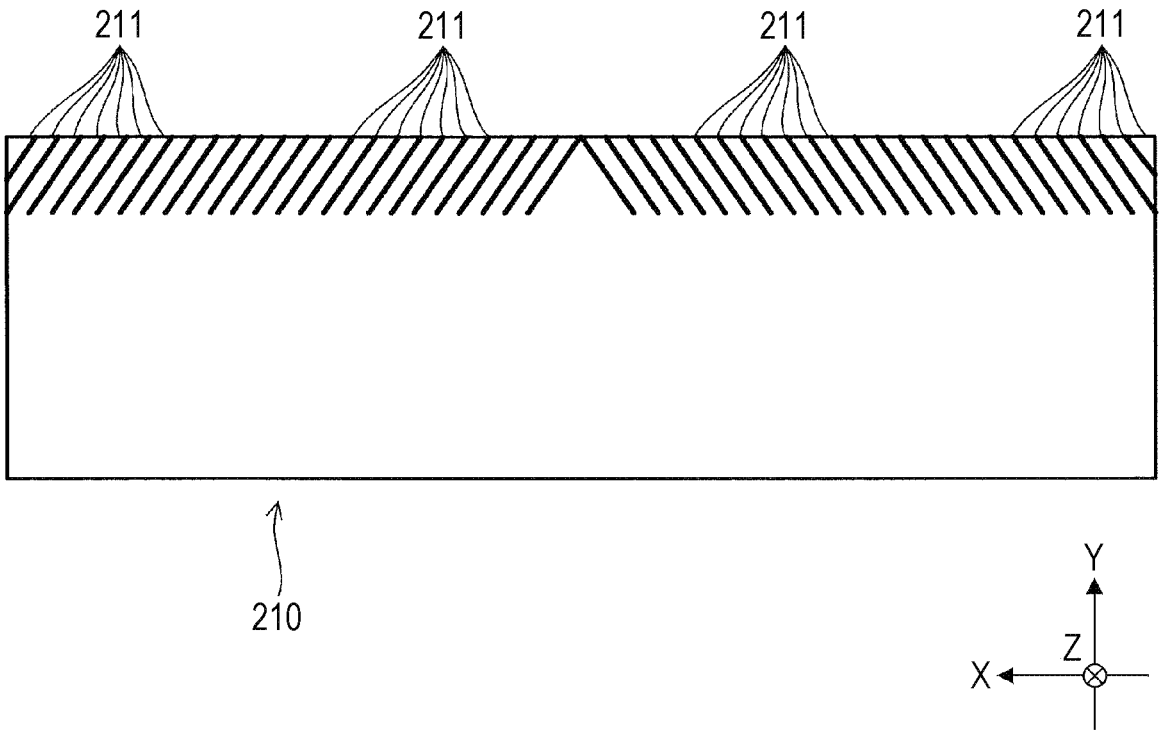
FIG. 6 is a view of an elastic member according to a modification example as viewed from the negative side in the Z direction.

Note that although the plurality of stress reducers 211 is arranged in parallel to each other in the X direction in the above embodiment, the present invention is not limited thereto, and it is not necessary that the plurality of stress reducers is arranged in parallel to each other in the X direction. For example, as illustrated in FIG. 6, the inclination direction of the stress reducers 211 may be different with respect to a center portion in the X direction of the elastic member 210.

Specifically, the stress reducers 211 are inclined toward a side opposite to a center portion in the X direction of the contact end of the elastic member 210 from the contact end of the elastic member 210.

In this manner, the frictional force acting on the stress reducers 211 can be directed to the end side of the elastic member 210, that is, the side toward the outside. Consequently, the effect of reducing the vibration of the internal stress can be further enhanced.

Further, although the stress reducers 211 are provided in the entire region in the X direction in the above embodiment, the present invention is not limited thereto, and the stress reducers may be provided in a part of the elastic member 210 in the X direction.

Figure 7:
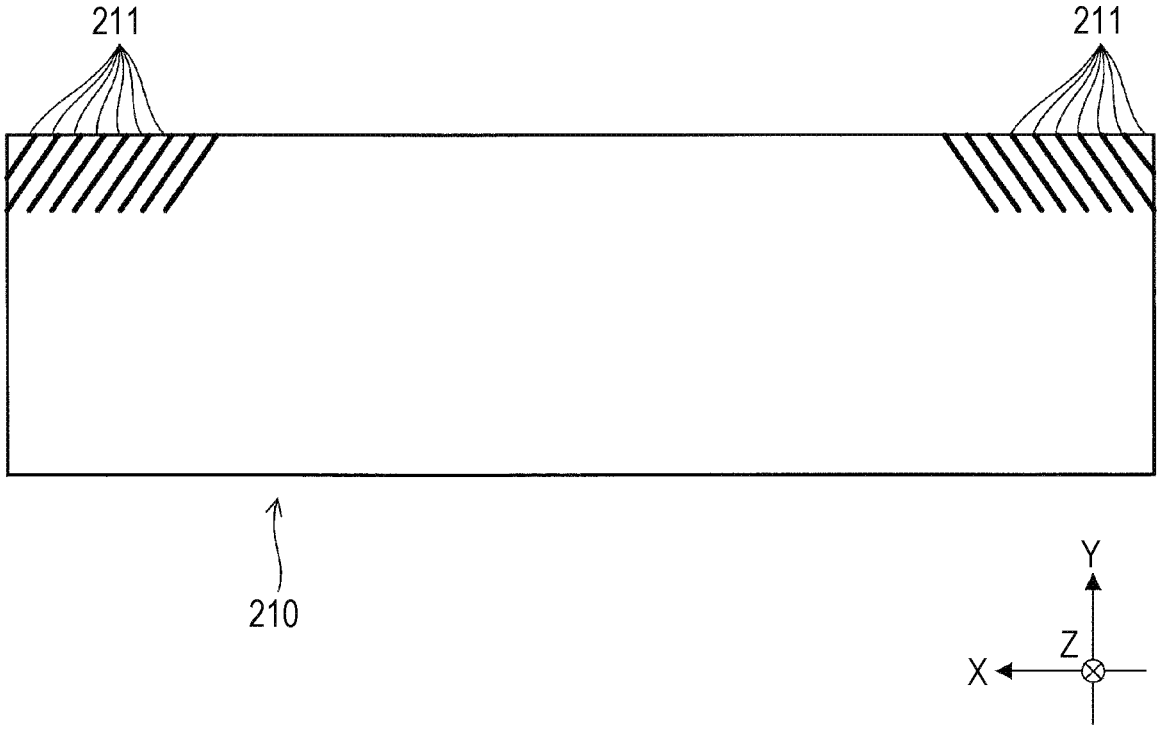
FIG. 7 is a view of an elastic member according to a modification example as viewed from the negative side in the Z direction.

For example, as illustrated in FIG. 7, the plurality of stress reducers 211 is provided at the end in the X direction of the elastic member 210.

The position of the end in the X direction of the elastic member 210 is a position corresponding to the end in the X direction of the photoconductor drum 413. That is, the position of the end in the X direction of the elastic member 210 is a position where the amount of lubricant applied to the surface of the photoconductor drum 413 tends to decrease, or a position where the toner image tends to decrease at the end of the image forming region.

Thus, the end in the X direction of the elastic member 210 is a portion where the curling of the elastic member 210 is likely to occur. By providing the stress reducers 211 only at the end of the elastic member 210 in the X direction, it is possible to suppress the occurrence of curling of the elastic member 210. Further, since the stress reducers 211 are provided only at a portion where it is highly necessary to provide the stress reducers 211, the manufacturing process of the elastic member 210 can be simplified.

Further, when there is a portion to which a load is likely to be applied other than the end of the elastic member in the X direction, the stress reducers may be provided only in a part other than the end.

Further, although the stress reducers are located on the side opposite to the contact portion with the photoconductor drum at the contact end in the above embodiment, the present invention is not limited thereto, and the stress reducers may be located on the contact portion side with the photoconductor drum.

However, when the stress reducers are located on the contact portion side, a deposit of the photoconductor drum may enter the stress reducers, and thus it is preferable to provide the stress reducers on the side opposite to the contact portion with the photoconductor drum. Further, in a case where the stress reducers are provided on the contact portion side, it is preferable to provide the stress reducers in a portion outside the contact portion between the elastic member and the photoconductor drum from the viewpoint of avoiding the deposit from entering the stress reducers.

Further, although the stress reducer is a groove or a slit in the above embodiment, the present invention is not limited thereto, and the stress reducer may be, for example, a convex portion extending in a direction inclined with respect to the Y direction.

Further, although the elastic member 210 is arranged in parallel to the X direction in the above embodiment, the present invention is not limited thereto, and the elastic member may be arranged to be inclined with respect to the X direction as long as the stress reducers are not perpendicular to the moving direction. According to this, by inclining the stress reducers, the inclination amount of the elastic member can be reduced. However, from the viewpoint of an arrangement space in the image forming apparatus, the elastic member is preferably arranged in parallel in the X direction.

Further, although the drum cleaning device assuming the photoconductor drum as the moving body is exemplified as the cleaning device in the above embodiment, the present invention is not limited thereto, and a device assuming a member other than the photoconductor drum, such as a belt cleaning device, as the moving body may be used as the cleaning device.

In addition, each of the above-described embodiments is merely an example of embodiments in carrying out the present invention, and the technical scope of the present invention should not be limitedly interpreted by these. That is, the present invention can be implemented in various forms without departing from the gist or main features thereof.

Figure 8:
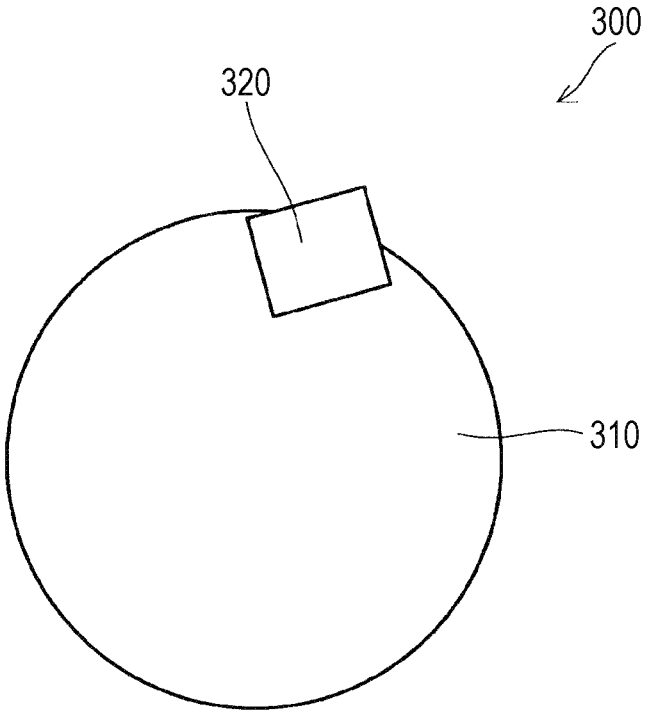
FIG. 8 is a diagram schematically illustrating an experimental apparatus used in a first evaluation experiment.

Next, an evaluation experiment of the cleaning device according to the present embodiment will be described. FIG. 8 is a diagram schematically illustrating an experimental apparatus 300 used in the first evaluation experiment. As illustrated in FIG. 8, the experimental apparatus 300 includes a disk member 310 (moving body) configured to be rotatable (movable) and a blade member 320 in contact with the disk member 310. The disk member 310 rotates when a driving force is transmitted from a driving source, which is not illustrated. The blade member 320 is an elastic member made of polyurethane, and has a size of 2 mm×10 mm×14 mm. A mounting angle and a pushing amount of the blade member 320 can be adjusted by a support portion, which is not illustrated.

Further, the experimental apparatus 300 is provided with an imaging member (not illustrated) with a built-in ¼ wavelength plate and a high-luminance light emitting diode (LED) light source (not illustrated) with a built-in circularly polarizing filter, in order to visualize a stress distribution in the blade member 320 using a photoelastic method. Thus, an optical image and a photoelastic image of the contact portion with the blade member 320 can be simultaneously acquired from the back side of the disk member 310.

First, in the first evaluation experiment, a photoelastic image was acquired and stress, a pull-in amount of the end of the elastic member, and vibration of the end of the elastic member were measured for each of a configuration in which the stress reducers were not provided (first comparative example), a configuration in which the blade member was arranged to be inclined by 10° with respect to the moving direction (second comparative example), a configuration in which the inclination angle with respect to the moving direction of the stress reducers was 0° (first example), and a configuration in which the inclination angle with respect to the moving direction of the stress reducers was 45° (second example).

Further, the stress reducers in the first example and the second example were slits, and had a depth of 1 mm, a length of 5 mm, and a distance from the adjacent stress reducer of 1 mm. Note that the same applies to the stress reducers in examples described later.

Figure 9A:
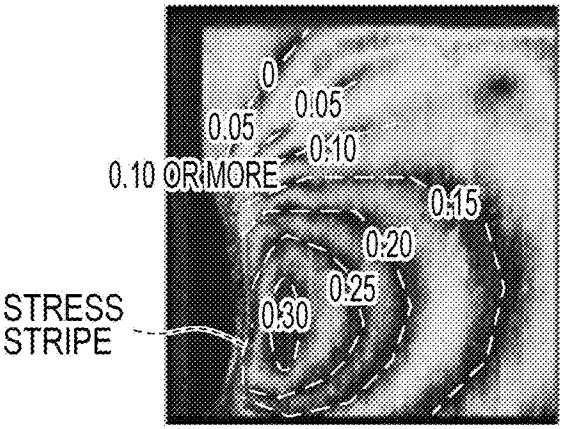
FIG. 9A is a view illustrating a photoelastic image of a first comparative example.

As illustrated in FIG. 9A, in the first comparative example, a plurality of isochromatic lines of stress is generated in a circular shape in the photoelastic image, there is a large stripe order, and the stress is high inside the blade member. Thus, as illustrated in FIG. 10, it was confirmed that the stress, the pull-in amount, and the vibration of the first comparative example were measured with relatively large values ("large" in FIG. 10).

Figure 9B:
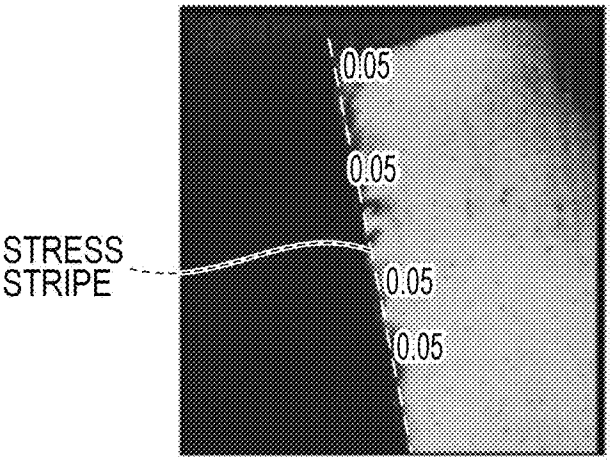
FIG. 9B is a view illustrating a photoelastic image of a second comparative example.

Further, as illustrated in FIG. 9B, in the second comparative example, the stripe order of the stress is small in the photoelastic image, and the stress inside the blade member is reduced. Thus, as illustrated in FIG. 10, it was confirmed that the stress, the pull-in amount, and the vibration of the second comparative example were measured with relatively small values ("small" in FIG. 10). However, in the second comparative example, since it is necessary to provide an arrangement space for the blade member, it is not a practical configuration.

Figure 9C:
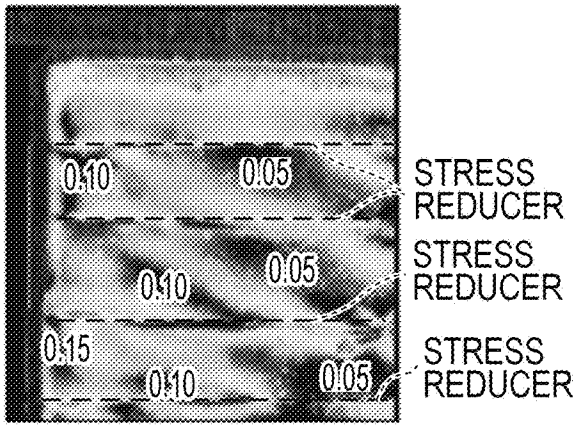
FIG. 9C is a view illustrating a photoelastic image of a first example.

As illustrated in FIG. 9C, in the first example, stripes of stress in the photoelastic image are linearly divided and suppressed along the stress reducers, and the stripe order is reduced, so that the internal stress of the blade member is reduced. That is, in the first example, the internal stress was reduced as in the first comparative example. Therefore, as illustrated in FIG. 10, it was confirmed that the stress and the pull-in amount of the first example were measured with relatively small values ("small" in FIG. 10). Further, although the vibration was not reduced as much as in the second comparative example, it was confirmed that the vibration was measured with a sufficiently small value ("medium" in FIG. 10) as compared with the first comparative example.

Figure 9D:
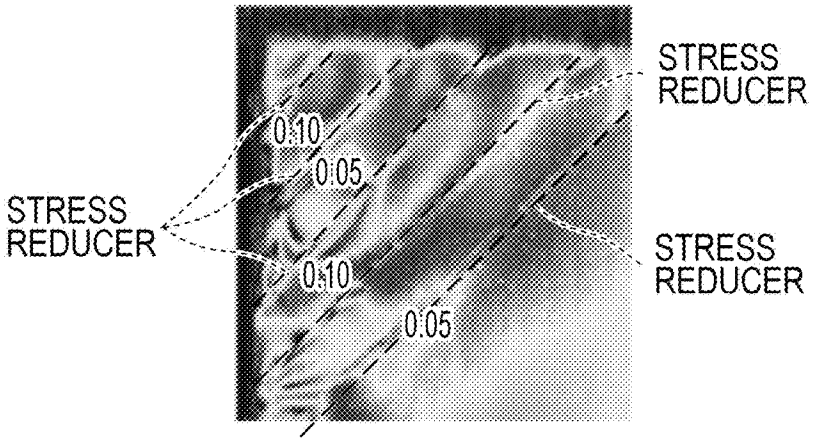
FIG. 9D is a view illustrating a photoelastic image of a second example.

As illustrated in FIG. 9D, in the second example, the stress in the X direction in the photoelastic image is transmitted in the Y direction along the stress reducers and suppressed, and the stripe order is reduced, so that the internal stress of the blade member is reduced. That is, in the second example, the internal stress was reduced as in the first comparative example. Therefore, as illustrated in FIG. 10, it was confirmed that the stress, the pull-in amount, and the vibration of the second example were all measured with relatively small values ("small" in FIG. 10).

Note that in the second example, similar measurement was also performed for the stress reducers having a depth of 0.5 mm and satisfactory results were confirmed, but it was confirmed that the stress reducers having a depth of 1 mm had better results.

Next, using the image forming apparatus 1 illustrated in FIG. 1, an evaluation experiment (second evaluation experiment) for evaluating the occurrence situation of curling in the elastic member was conducted. FIG. 11 is a table illustrating experimental results of the second evaluation experiment. The third example has a configuration illustrated in FIG. 4. The fourth example has a configuration illustrated in FIG. 6. The fifth example has a configuration illustrated in FIG. 7. The sixth example has a configuration in which the stress reducers are provided in a portion of the elastic member on a side in contact with the photoconductor drum, and the stress reducers are provided at a position 1 mm away from the contact portion with the photoconductor drum. The comparative example is the first comparative example of the first evaluation experiment.

As illustrated in FIG. 11, it was confirmed that curling occurred in the elastic member in the comparative example ("×" in FIG. 11), whereas it was confirmed that the occurrence of curling was suppressed in all of the third to sixth examples ("○" or "⊙" in FIG. 11). In particular, in the fourth example, it was confirmed that the occurrence of curling of the elastic member was remarkably suppressed ("⊙" in FIG. 11).

Next, in the configuration illustrated in the fourth example, an evaluation experiment was conducted to evaluate effectiveness of the range of the angle of the stress reducers. Specifically, in the third evaluation experiment, in the configuration of the fourth example, an elastic member having a different angle with respect to the Y direction in the stress reducers was used, and the occurrence situation of curling in the elastic member was evaluated similarly to the second evaluation experiment. FIG. 12 is a table illustrating experimental results of the third evaluation experiment.

As illustrated in FIG. 12, it was confirmed that the occurrence of curling was suppressed at any angle ("○" or "⊙" in FIG. 12). In particular, it was confirmed that the occurrence of curling of the elastic member was remarkably suppressed in the case of the angles of 10°, 45°, and 80° as compared with the cases of the angles of 5° and 85° ("⊙" in FIG. 12). That is, it was confirmed that the range of the angle formed by the stress reducers and the Y direction in the present embodiment is preferably in the range of 10° to 80°.

Although embodiments of the present invention have been described and illustrated in detail, the disclosed embodiments are made for purposes of illustration and example only and not limitation. The scope of the present invention should be interpreted by terms of the appended claims

What is claimed is:

1. An elastic member that comes into contact with a moving body that moves in a predetermined moving direction to scrape off a deposit on the moving body, the elastic member comprising:

a stress reducer that is provided at a contact end on a side to be in contact with the moving body and reduces vibration of internal stress generated due to contact between the moving body and the elastic member, wherein the stress reducer extends in a direction that is not perpendicular to the moving direction when the elastic member comes in contact with the moving body, an angle formed by the stress reducer and the moving direction is in a range of 10° to 80°, and the elastic member includes a portion contacting the moving body and a surface opposite to the portion contacting the moving body, and the stress reducer is provided on the surface opposite to the portion contacting the moving body.

2. The elastic member according to claim 1, wherein the stress reducer is a groove or a cut.

3. The elastic member according to claim 1, wherein a plurality of the stress reducers is provided side by side in a predetermined direction along the contact end.

4. The elastic member according to claim 3, wherein the stress reducer is provided in a part of the predetermined direction.

5. The elastic member according to claim 4, wherein the stress reducer is provided at an end in the predetermined direction.

6. The elastic member according to claim 4, wherein the stress reducer is inclined with respect to the moving direction from the contact end and is inclined toward a side opposite to a center portion in the predetermined direction at the contact end.

7. The elastic member according to claim 3, wherein the stress reducer is provided in an entire region in the predetermined direction.

8. A cleaning device that cleans a moving body, the cleaning device comprising:

the elastic member according to claim 1; and a support member that supports the elastic member.

9. The cleaning device according to claim 8, wherein the support member supports the elastic member in such a manner that the stress reducer is on a side opposite to a contact portion side with the moving body at the contact end.

10. An image forming apparatus comprising:

a moving body that moves in a predetermined moving direction; and the cleaning device according to claim 8.

* * * * *